US005650787A

United States Patent [19]

Lim et al.

[11] Patent Number: 5,650,787

[45] Date of Patent: Jul. 22, 1997

[54] SCANNING ANTENNA WITH SOLID ROTATING ANISOTROPIC CORE

[75] Inventors: K. C. Lim, Agoura; J. D. Margerum, Woodland Hills; A. M. Lackner, Los Angeles; E. Sherman, Culver City, all of Calif.

[73] Assignee: Hughes Electronics, Los Angeles, Calif.

[21] Appl. No.: 448,827

[22] Filed: May 24, 1995

[51] Int. Cl.[6] ..... H01Q 3/22

[52] U.S. Cl. ..... 342/375; 343/768; 343/911 R; 343/771

[58] Field of Search ..... 342/375; 343/754, 343/768, 785, 911 R, 771

[56] References Cited

U.S. PATENT DOCUMENTS

| | | | |
|---|---|---|---|
| 3,568,208 | 3/1971 | Hatcher | 343/768 |
| 3,576,581 | 4/1971 | Radomes | 343/872 |
| 3,631,501 | 12/1971 | Buscher . | |
| 4,119,971 | 10/1978 | Stark | 343/768 |
| 4,170,778 | 10/1979 | Bowman | 343/771 |
| 4,458,250 | 7/1984 | Bodnar et al. | 343/768 |
| 4,944,576 | 7/1990 | Lackner et al. . | |
| 5,179,993 | 1/1993 | Bak et al. . | |
| 5,184,233 | 2/1993 | Lim et al. . | |
| 5,194,972 | 3/1993 | Lim et al. . | |
| 5,206,613 | 4/1993 | Collier et al. | 333/156 |

OTHER PUBLICATIONS

Hansen ed., *Microwave Scanning Antennas,* Chapter 1 by Kummer, Academic Press, 1966, pp. 64–65.

Yager et al., "Formation of Tubules by a Polymerizable Surfactant," *Molecular Crystals Liquid Crystals,* vol. 106, 1984, pp. 371–381.

Schnur et al., "Lipid–based Tubule Microstructures," *Thin Solid Films,* vol. 152, 1987, pp. 181–206.

J.A.E. Bell et al, "Properties of Nickel Coated Carbon and Kevlar Fibres Produced by Decomposition of Nickel Carbonyl," 25th Annual SAMPE Tech. Conf. Oct. 21–24, 1991.

R.A. Weiss et al., ed. "Liquid–Crystalline Polymers", ACS Symposium Series, A. Chem. Soc., Wash. D.C., 1990, Chapter 1, pp. 1–13.

*Primary Examiner*—Thomas H. Tarcza

*Assistant Examiner*—Dao C. Phan

*Attorney, Agent, or Firm*—Vijayalakshmi Duraiswamy; Wanda K. Denson-Low

[57] ABSTRACT

A scanning array antenna employs a solid rotating core having an anisotropic refractive index within an apertured waveguide that emits radiation in response to an input beam propagating through the waveguide. Rotating the core changes its refractive index relative to the input beam, causing the radiated beams to undergo an angular scanning. The solid rotating waveguide core can be formed from a dispersion of aligned elongate conductive members in an isotropic dielectric, from a liquid crystal medium, or from a dispersion of aligned elongate conductive members in a liquid crystal medium. The antenna is operable in reciprocal transmission and reception modes.

25 Claims, 3 Drawing Sheets

FIG. 1a.
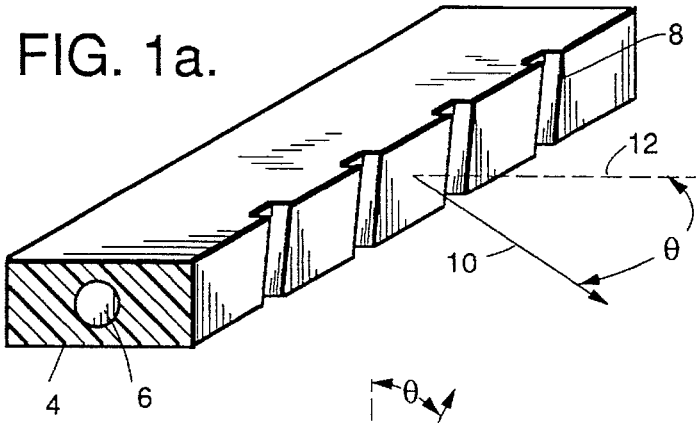
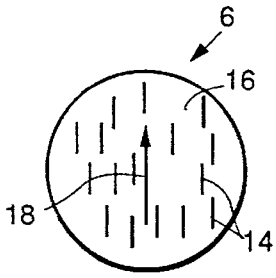
FIG. 2.
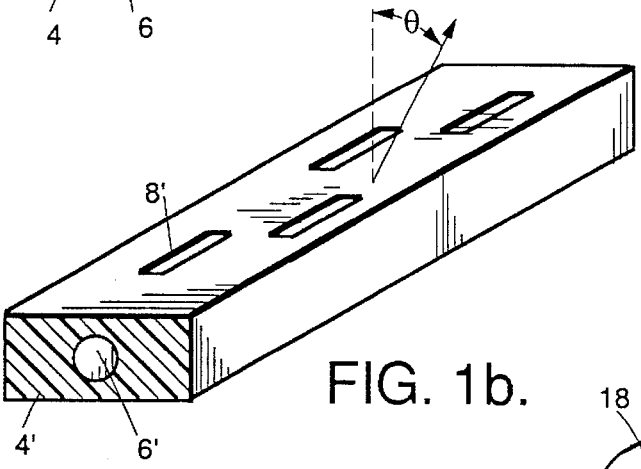
FIG. 1b.
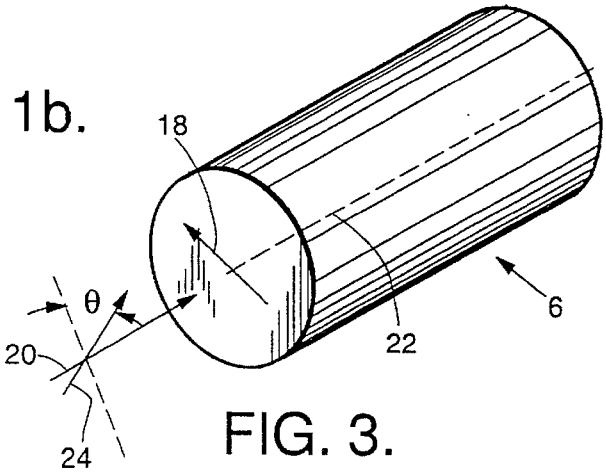
FIG. 3.
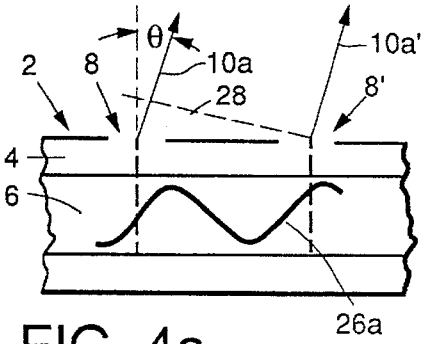
FIG. 4a.
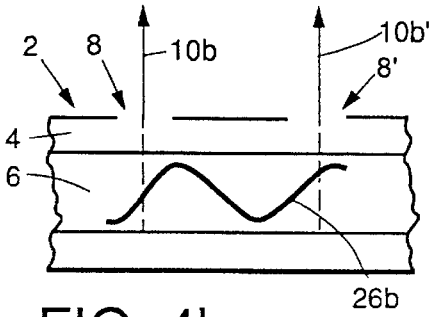
FIG. 4b.

FIG. 7.
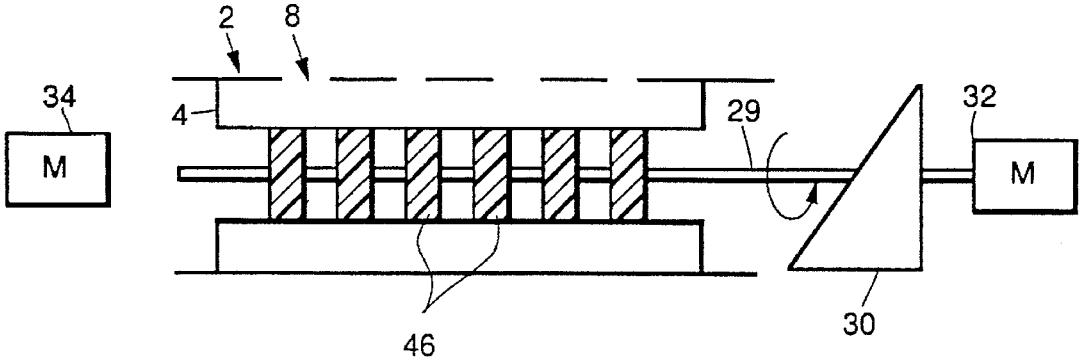
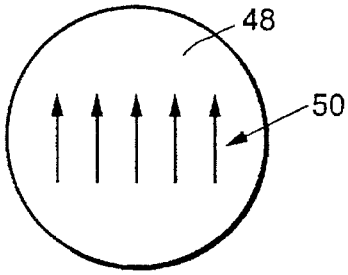
FIG. 8a.
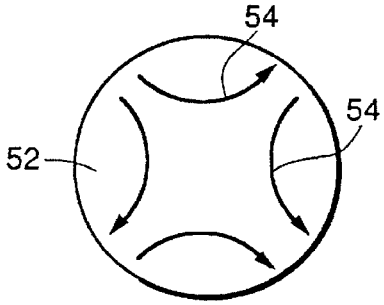
FIG. 8b.
FIG. 9.
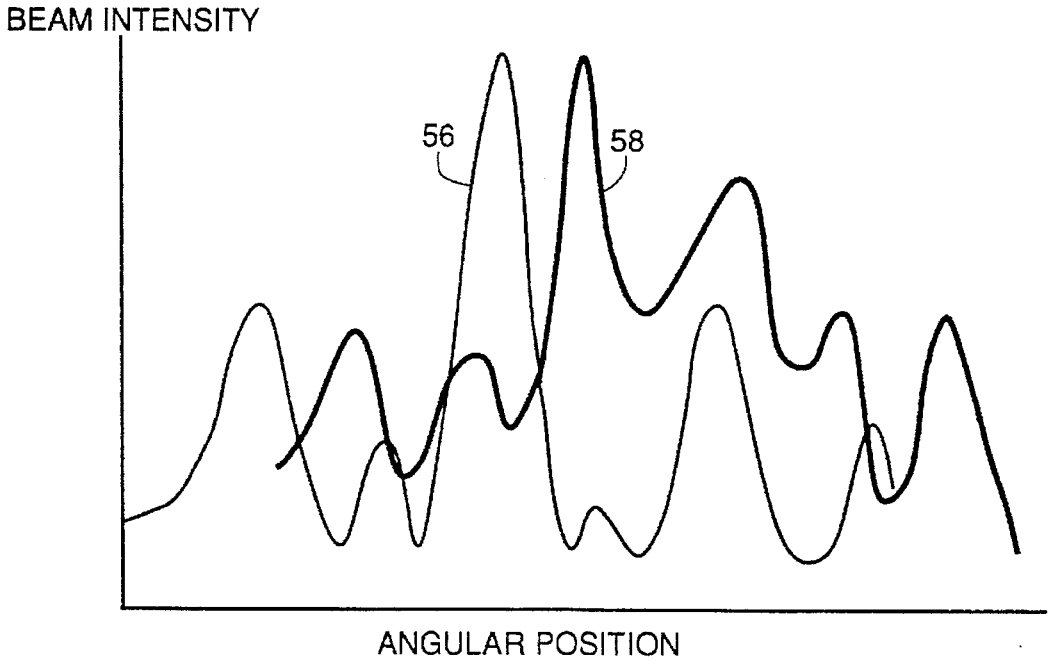

SCANNING ANTENNA WITH SOLID ROTATING ANISOTROPIC CORE

BACKGROUND OF THE INVENTION

1. Field of the Invention

This invention relates to scanning antennas, and more particularly to antennas in which a scanning action is achieved by rotating an anisotropic medium relative to an input signal.

2. Description of the Related Art

Present scanning antennas are quite costly and technologically sophisticated. They can be divided into two main classes: mechanically rotating systems and phased array systems. The systems that use a mechanical rotation to achieve a scanning movement are generally bulky, and the rotating mechanisms require periodic maintenance. Scanning phased array antenna systems, on the other hand, typically use ferrite and diode phase shifters that are high cost precision items requiring considerable amounts of power to operate.

Another system for which a prototype has been demonstrated employs a series of parallel metal plates that rotate about an eccentric axis within a slotted waveguide. In the course of their rotation the plates move in and out of the field lines within the waveguide; this causes the speed at which an input beam propagates through the waveguide, and accordingly its wavelength, to vary. The waveguide slots are spaced periodically with respect to the limits of the wavelength range such that the signal radiated out through the slots is steered back and forth through a scanning angle as the plates continue to rotate. This type of system is expected to be costly and difficult to manufacture in a mass production process because the dimensional precision of the rotating core structure and of its axial positioning are highly critical, and the system is quite lossy and has a high power consumption. This type of system is described in Hansen ed., *Microwave Scanning Antennas,* Chap. 1 by Kummer, Academic Press, 1966, pages 64–65.

Another approach to the achievement of a scanning antenna is described in U.S. Pat. No. 3,631,501 to Busher. In this patent, metallic particles are dispersed within a liquid optically isotropic medium. (An optically isotropic medium is one in which the index of refraction is independent of both the direction in which light propagates through the medium, and of the light's state of polarization.) Unfortunately this type of antenna did not work well because the metallic particles were not stable within the liquid, and tended to settle out. Also, an unduly large electric field (greater than $10^5$ V/cm) was needed to obtain the 1 microsecond switching speeds mentioned in the patent.

It would be very desirable to have a simple scanning antenna system with low maintenance requirements, compactness, ruggedness, low cost and low power consumption for millimeter range radar applications such as automobile collision avoidance, cruise control radar systems and aircraft ground approach radar systems. However, there is no known radar antenna system that is compact and economic enough to satisfy all of these requirements.

SUMMARY OF THE INVENTION

The present invention seeks to provide a new scanning radar system that has, among other things, low cost, compactness, a very wide temperature operating range and low maintenance requirements.

These goals are realized with a scanning antenna system that employs a solid electromagnetically anisotropic phase delay medium, in conjunction with an output radiating device that radiates an output signal from the phase delay medium when a polarized input beam is propagated through the medium. A relative rotation is produced between the optical axis of the phase delay medium and the polarization axis of a polarized input beam, thereby varying the medium's effective refractive index and the beam's wavelength within the medium. This in turn causes the radiated output to scan through a range of output angles that correspond to the variation in the medium's effective refractive index as the rotation progresses.

The output radiating means is preferably implemented as an apertured waveguide, preferably with diagonal aperture slots, with the phase delay medium rotatably secured within the waveguide by a dielectric sleeve. The medium's optical axis is perpendicular to its rotational axis, such that rotating the medium while a polarized input beam is directed through it parallel to the rotational axis produces a scanning array of output beams from the waveguide slots.

The necessary anisotropic solid medium can be implemented with a number of different structures. It can be formed as a dispersion of aligned liquid crystals within a polymer matrix, with the polymer and liquid crystal composite having a softening point above the medium's intended operating temperature; as a dispersion of aligned liquid crystal droplets within a polymer matrix, with the clear point of the droplets well above the medium's intended operating temperature; as a dispersion of generally aligned elongate conductive members such as graphite fibers, aluminum needle-shaped particles, steel wires, metallized microtubules, or conductive polymers within an isotropic dielectric; or as a dispersion of such conductive members within a liquid crystal polymer.

The alignment of the liquid crystals, liquid crystal polymers, and conductive members can be implemented with various techniques, including alignment by magnetic fields, electrical fields, or flow during the formation of the anisotropic core material.

The antenna's operation is reciprocal, so that it can be employed as either a transmitter or a receiver, or both. The angle over which the scan occurs can be selected by adjusting the density of the aligned elements that produce the medium's anisotropicity, while the angle of the scanning center line can be shifted in one direction or the other by an appropriate selection of the spacing between the waveguide apertures relative to the minimum and maximum input beam wavelengths within the waveguide.

Further features and advantages of the invention will be apparent to those skilled in the art from the following detailed description, taken together with the accompany drawings, in which:

BRIEF DESCRIPTION OF THE DRAWINGS

FIGS. 1*a* and 1*b* are perspective views showing examples of scanning array antennae implemented in accordance with the invention;

FIG. 2 is a section view of the antenna's rotatable core, illustrating the alignment of anisotropic-producing particles or molecules therein;

FIG. 3 is a perspective view illustrating the orientation of the antenna core relative to an input beam;

FIGS. 4*a*–4*d* are sectional diagrams illustrating the dependence of the output beam's direction upon the input beam's wavelength, relative to the periodicity of the apertured waveguide within which the antenna core is housed;

FIG. 7 is a simplified sectioned view illustrating a segmented core that can be substituted for the continuous cores of the previous figures;

FIGS. 8*a* and 8*b* illustrate two circular waveguide propagation mode configurations that are respectively suitable and unsuitable for use with the invention; and FIG. 9 is a graph of the scanning action achieved with a prototype of the invention.

DETAILED DESCRIPTION OF THE INVENTION

Figure 4C:
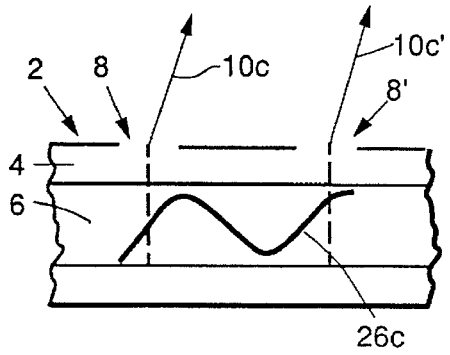

FIG. 1 shows a new scanning array antenna that is very useful in applications such as automobile collision avoidance systems, radar detection/sensing systems for autonomous vehicles, friend-or-foe short range radar identification, and short range airport ground radar systems. It consists of an apertured waveguide 2, a sleeve 4 formed from a dielectric material such as Teflon within the waveguide, with the outer sleeve surface complimentary to the inner waveguide surface, and a rotatable solid phase delay medium 6 in the form of a cylinder held within a corresponding internal opening in the sleeve 4. The phase delay medium 6 is selected to have an anisotropic refractive index, meaning that the effective refractive index which it presents to a polarized beam propagating through the medium varies as the direction of the medium's optical axis is altered relative to the beam's polarization. This is due to the medium having more than one principal index of refraction, the ordinary and the extraordinary indexes, and is a well know phenomenon. The characteristic of dividing an input beam into ordinary and extraordinary beams is also referred to as birefringence.

The waveguide has a series of periodically spaced apertures along one side, preferably in the form of parallel slots 8 that are oriented at an angular offset to the waveguide axis. An electro-magnetic beam propagating through the phase delay core 6 within the waveguide establishes circulating currents around the core. The slots 8 interrupt the field lines associated with the current flow, thus causing a beam 10 to be radiated out from each slot with a frequency equal to the frequency of the input beam through the core. As described in further detail below, the angle θ between the output beam 10 and a perpendicular 12 to the slotted waveguide wall depends upon the differential between the spacing of successive waveguide slots 8, and on the waveguide wavelength of the input beam. The waveguide's dimensions are determined by the input beam frequency, and to the first order are the same as for an air-filled waveguide.

The basic design of the slots 8 for the linear waveguide 2 travelling wave array antenna is conventional and numerous different types of conductive waveguides could be used, such as ridged, rectangular, square or circular designs. The beam angle θ of the slotted rectangular waveguard linear array antenna illustrated in FIG. 1 can be expressed as:

$$\sin\theta = \left(\frac{1}{s} - \sqrt{\frac{n^2}{\lambda_o^2} - \frac{1}{\lambda_g^2}}\right)\lambda_o$$

where n is the effective refractive index of the anisotropic phase delay medium 6, $\lambda_o$ and $\lambda_g$ are the wavelengths of the electro-magnetic input wave respectively in free space and in the waveguide, which can be loaded with the dielectric medium 6, and s is the periodic spacing between adjacent slots.

The interior opening in the dielectric sleeve 4 provides a bearing surface for rotation of the phase delay core 6, and a mechanical support to hold the rotating core in place; the sleeve itself has no appreciable effect upon the antenna's radiating characteristics. The design of slots 8 follows that of conventional slotted waveguides, except the slot spacing is determined by the above equation and by the required nominal beam angle θ. The slot widths preferably increase progressively in the direction of the input beam to establish equal power outputs from each of the slots, since the amount of remaining available radiating power diminishes from slot to slot. In a demonstration of the invention, simple rectangular slots and edge shunt, in-phase slots respectively cut along the narrow sides of rectangular waveguides were used. To lower the production costs of the antenna, metal can be directly coated onto the sleeve 4 to form the apertured waveguide antenna. As illustrated in FIG. 1*b*, the invention is also applicable to a birefringent core 6' in a sleeve 4' that includes an array of slots 8' aligned parallel to the core along the broader face of the waveguide.

The anisotropic (birefringent) core 6 is a long, thin cylindrical dielectric composite solid that fits snugly into the center cylindrical opening in the sleeve 4 and can be rotated freely therein. It extends along the full length of the slots 8. The input end of the core 6 is preferably tapered, or shaped with a quarter wavelength step (not shown), to provide a good impedance match to an input beam, which will generally be in the mm. range.

The detailed physical structure and the materials used for the anisotropic core 6 may vary in accordance with particular design requirements. The basic requirements are that the core have a sufficiently large birefringence and reasonably low average refractive indices. Several different types of materials can be used to fabricate the core 6 with the desired optical properties. As illustrated in FIG. 2, the core 6 in general consists of a dispersion of aligned elements 14 within a dielectric matrix 16. The aligned elements 14 are selected to produce the desired anisotropic characteristics, giving the core an optical axis 18 along a diameter perpendicular to its rotational axis. Some examples of structures that can be used for the solid phase delay medium 6 are: (1) a dispersion of aligned elongate conductive members such as graphite fibers, aluminum needle-shaped particles, steel wires or metallized microtubules, in an isotropic dielectric polymer matrix composite; (2) aligned solid polymer liquid crystals; (3) a dispersion of aligned elongate conductive members in an aligned polymer liquid crystal composite, and (4) aligned liquid crystal droplets in a solid polymer. Details of preferred fabrication techniques for each of these approaches will now be described.

Dispersion of aligned elongate conductive members in isotropic dielectric

Elongate conductive particles are dispersed randomly within prepolymer or monomers. While an external electric or magnetic field is supplied to align the particles, the monomer is polymerized to form a uniform dielectric polymer matrix that locks in the alignment and position of the particles. The particles have a high length/width ratio, with a length preferably not more than about a tenth the wavelength of the intended input radiation. For mm range radar signals with wavelengths on the order of 1 cm, the particle length should not be greater than about 1 mm. The particle lengths are preferably at least ten times their widths.

Metallized microtubules, which are hollow tubule-shaped microstructures, are presently the preferred implementation within this category. The fabrication of these structures is described in Yager et al.,"Formation of Tubules by a Polymerizable Surfactant", *Molecular Crystals Liquid Crystals,* vol. 106, 1984, pages 371–381, while a process for the deposition of thin metal coatings onto the microtubules is described in Schnur et al., "Lipid-based Tubule Microstructures", *Thin Solid Films,* vol. 152, 1987, pages 181–206. Microtubules with metal coatings such as nickel or permalloy can be aligned with either an electric or a magnetic field during the formation of the anisotropic solid polymer composite.

An experimental example of such an anisotropic solid core rod is one made with 0.2% (by weight) of nickel-coated microtubules dispersed in Optistik 2060, and aligned with a 1.5 kG magnetic field while cured (polymerized) with ultraviolet light for two hours. This was done in a 4 cm long Teflon tube (4.4 mm outside diameter, 3.35 mm inside diameter). The solid anisotropic rod composite was removed from the Teflon tube, placed in a millimeter wave (30 GHz) Mach-Zehnder interferometer, and its phase shift was measured as it was axially rotated in the rectangular waveguide. It showed a 60° phase shift when its anisotropic direction was rotated from parallel to perpendicular to the millimeter wave E-field. This corresponds to an effective birefringence of $\Delta n=0.04$, although the actual $\Delta n$ of the rod is higher since the rod did not fill the rectangular waveguide cavity.

Aluminum needle-shaped particles that can be used to produce the desired anisotropic alignment are fabricated photolithograhically from aluminum deposited on a silicon dioxide substrate, for example as described by Bak et al., U.S. Pat. No. 5,179,993 (Jan. 19, 1993). The needles can be removed from the substrate by immersion in a dielectric fluid and agitating ultrasonically. They need to be aligned in an electrical field since they are not magnetic.

Graphite fibers for incorporation into polymeric hosts can be obtained from conventional masses of graphite fiber bundles by simply grinding them down to the desired dimensions. However, nickel-coated fibers are preferred, as described by Bell and Hansen, *23rd International SAMPE Technical Conference,* Oct. 21–24, 1991. Nickel-coated carbon fibers of this type were obtained from INCO/VaproFab Inc., such as 5 or 7 μm diameter carbon fibers coated with 900Å of 20% nickel, and chopped to the desired length.

Conductive polymers, such as polyaniline, can be made in elongated electrically conductive fibers which can be dispersed and aligned in isotropic host polymers.

A very wide selection of polymeric materials can be used as isotropic host media for containing the anisometric or elongated conductive particles described above. In general, the best polymeric materials will exhibit a low loss in the frequency range of interest for the application of the devices. For many applications it will also be advantageous or necessary to have good mechanical strength over the operational and storage temperature ranges. For some applications the material should be hard and inflexible, while for others a slight rubberiness and some flexibility may be preferable. It is of course advantageous to employ isotropic host materials in which the anisometric particles can be readily dispersed and aligned.

For low loss in the frequency range of interest (about 1 to 100 GHz) it is desirable to have a host polymer with few or no polar groups, since polar groups will tend to rotate to follow the field and thus produce a loss in the energy of the transmitted radiation. Polymers with few or no polar groups, or with groups having a very low polarity, include polyethylene, polypropylene, ethylene-propylene copolymers, polybutylene, polyisobutylene, polymethylpentene, polystyrene, poly(α-methylstyrene), poly(2-methylstyrene), poly(3-methystyrene), poly(4-methylstyrene), poly(2, 4-dimethylstyrene), poly(2,5-dimethylstyrene), poly(3,4-dimethylstyrene), poly(ethylstyrene), poly(iso-propylstyrene), poly(4-tert-butylstyrene), polyvinylnaphthalene, and the like. Suspensions of particles in the polymers can be formed by suspending the particles in the monomers, or in monomers thickened with some of the dissolved polymers, and then polymerizing the monomers while the particles are aligned by a magnetic field. The polymerization can be effected by including an initiator of free-radical polymerization in the composition, where the polymerization is initiated either thermally or with ultraviolet light or other actinic radiation. Crosslinking monomers, such as divinylbenzene, may also be included if it is desirable to form a crosslinked, thermosetting polymer. Alternatively, the polymer may be a thermoplastic, linear polymer that can be melted, and then after forming a suspension of aligned elongated particles in the melt, allowed to resolidify by cooling to freeze in the particles in their aligned positions. Poly(tetrafluoroethylene) is also a suitable polymer, but the preparation of a suspension of particles in this polymer is much more difficult, since the polymer cannot readily be formed from a liquid monomer, nor can the polymer be obtained as a melt.

It is also acceptable to have materials with polar groups if these are very tightly bound in the solid polymer so that they cannot rotate and follow the field at the high frequencies employed. Thus, poly(methyl methacrylate) is acceptable, as are some aromatic ester polymers. Other methacrylates will also be acceptable if they are used in a hard and rigid state below their glass transition temperature, so that the polar ester groups cannot follow the high frequency field. This would include poly(tert-butyl methacrylate) and poly (phenyl methacrylate); however, acrylate polymers and methacrylate polymers with long alkyl chains in the ester groups and low glass transition temperatures tend to be more lossy and are much less desirable or only marginally useful. Highly crosslinked polymers, such as some highly crosslinked epoxy polymers or cyanate ester polymers, or highly crosslinked siloxane polymers derived primarily from tri- and tetrafunctional silane monomers, or glassy polycarbonates, may also be acceptable for some applications. Again the dispersion of the anisometric particles can be achieved by aligning them as a suspension in monomers, or in monomers containing some polymer, and the polymerizing the remaining monomer while the particles are aligned. When the polymer is a thermoplastic that cools to a hard, glassy polymer, the aligned particle dispersion can again be achieved in the melt. It is particularly desirable to use only polymers that do not absorb significant quantities of water, since the water in the polymer would tend to make the composite devices lossy. Thus, for example, polymers with many polar hydroxyl groups, such as the cellulosic materials, which will tend to absorb water from the atmosphere, are more difficult to be used as a low loss media. It can be seen from these examples, however, that a wide range of isotropic polymers is nevertheless available for use as a host matrix for the elongated particles in making useful devices.

Aligned solid liquid crystal polymers

Many oriented solid state liquid crystal polymers also can be used as anisotropic materials for rotating core radar scanners. In general the liquid crystalline polymer architecture for this purpose can be selected from rod-like mesogenic groups in structures which are liquid crystal main chain polymers, liquid crystal side chain polymers, liquid crystal side chain elastomers, and liquid crystal thermoset polymers, as well as from disc-like mesogenic groups in liquid crystal main chain polymers and in liquid crystal side chain polymers as described in R. A. Weiss and C. K. Ober, editors, "Liquid-Crystalline Polymers", *ACS Symposium Series* 435, American Chemical Society, Washington, D.C., 1990. A wide range of polymeric materials can be used, selected from polyesters, polyamides, polycinnamates, polyhydrocarbons, polysiloxanes, polyphosphazenes, and many others. These can be used in polymer, copolymer, block polymer, and crosslinked polymer structures. Substantial amounts of low molecular weight liquid crystals can be added as plasticizers, as long as their anisotropies can be oriented in the same direction as the liquid crystal polymer. The selection criteria are that the liquid crystal polymer must be made in the form of a stable solid for a rotating core, which has significant anisotropic dielectric properties in the radar region (e.g., 1 to 100 GHz) that are uniformly averaged (in magnitude and direction) over the wavelength being used (e.g., 30 to 0.3 cm), and which has relatively low loss in this radar range. The selection factors regarding loss properties are similar to those discussed above for host polymers. Several methods can be chosen for the uniform alignment of the polymeric materials for anisotropic properties, depending upon the type of polymer system being used. These methods include external field (magnetic or electrical) alignment during hardening steps such as monomer polymerization, crosslinking, cooling of thermoplastics, and solvent evaporation, and flow or sheer alignment such as in extrusion processes. The polymerization and crosslinking steps can be initiated thermally or photochemically, depending upon the polymer system and the initiators added. The solid state rotating cores can be cut out of larger pieces, or formed in molds of the desired sizes.

An experimental example of an anisotropic solid liquid crystal rod is a polymer made by thermal polymerization of an aromatic ester diacrylate monomer in the presence of a 3 KG magnetic field perpendicular across the long axis of the rod. The monomer had the following structure:

$$[CH_2{=}CHCOO(CH_2)_6O(C_6H_4)COO(C_6H_3CH_3)-]_2$$

It was made into a 6.1 cm long rod of 0.22 cm diameter, and it was studied in a 30 GHz waveguide with phase shift measurements made in a Mach-Zehnder interferometer. The effective birefringence at 30 GHz was found to be $\Delta n=0.068$.

Dispersion of aligned elongated conductive particles in a liquid crystal polymer A higher level of anisotropy can be obtained when aligned dispersions of conductive elongated particles, such as those described above, are aligned in liquid crystal polymers with their dielectric anisotropy aligned in the same direction as those of the polymer. This type of medium can be made by first dispersing the particles in a fluid (such as a liquid crystal) prior to solidification by cooling, polymerization, crosslinking, etc. as discussed above. Then the solidification step is made in the presence of an external aligning magnetic or electric field. If the solidification is done by cooling the composite mixture below its melting point, then the liquid crystal polymer composite must have a softening point temperature well above the operational ambient temperatures.

An experimental example of an anisotropic solid liquid crystal polymer rod containing elongate conductive particles is a composite formed from 67% of the polymer liquid crystal LCP95 (Merck, Ltd.), with 33% of the nematic liquid crystal BDH-K15 (Merck, Ltd.) added as a plasticizer, mixed with 0.27% (by weight) of nickel-coated microtubules. The liquid crystal components have the following structures:

LCP95 $-[CH_2CH]_n-$
$\quad\quad\quad have not been determined, although such a medium will exhibit an average effective refractive index n and an output beam angle relationship $\sin\theta=f(n)$, where $\theta$ is the angle by which the output beam diverges from a perpendicular to the waveguide. The isotropic case is described below to provide a better intuitive understanding.

In FIG. 4*a*, it is assumed that the input beam's polarization is perpendicular to the optical axis of the phase delay medium 6. Accordingly, the medium's effective refractive index is at a minimum and gives the beam a minimum phase delay. The beam's waveform within the medium is indicated by reference numeral 26*a*. Because of the minimum phase delay the beam's wavelength is at a maximum, and is illustrated as being somewhat greater than the spacing between successive waveguide slots 8. Accordingly, the radiated output beams emitted from the waveguide slots are directed along an off-perpendicular angle to the waveguide. With the input beam propagating from left to right, the output beams will be offset clockwise from a perpendicular to the waveguide as illustrated. This is because the beam 10*a* emitted from the left waveguide slot 8 "leads" the beam 10*a*' emitted from the right waveguide slot 8', in the sense that a positive-sloped zero crossing of the waveform 26*a* is aligned with slot 8 before the next positive-sloped zero crossing of the waveform aligns with the slot 8' as the beam travels towards the right. Thus, the output beam 10*a*' at the instant it is emitted from the slot 8' will correspond in phase to a portion of the beam 10*a* that was emitted from slot 8 slightly earlier in time. These two in-phase segments of the output beams 10*a* and 10*a*' are shown connected by the dashed line 28, which is perpendicular to both output beams; the output beams are emitted at the angle shown to satisfy this requirement.

Referring now to FIG. 4*b*, assume that the core 6 has been rotated so that its optical axis is more parallel with the input beam polarization than in FIG. 4*a*. This increases the core's effective refractive index, thus increasing the beam's phase delay and yielding a beam waveform 26*b* with a longer wavelength. In FIG. 4*b* the input beam wavelength is illustrated as being equal to the periodic spacing between successive waveguide slots 8 and 8'. Corresponding portions of the waveform are thus aligned with the two slots simultaneously, and the resulting output beams 10*b* and 10*b*' are radiated substantially perpendicular to the waveguide. The output beams will thus scan between the off-perpendicular angle of FIG. 4*a* and the perpendicular direction of FIG. 4*b* as the core 6 continues to rotate within the waveguide. Assuming that FIGS. 4*a* and 4*b* correspond respectively to perpendicular and parallel alignments between the core's optical axis and the input beam polarization, these beams angles define the limits of the output scanning.

Figure 4D:
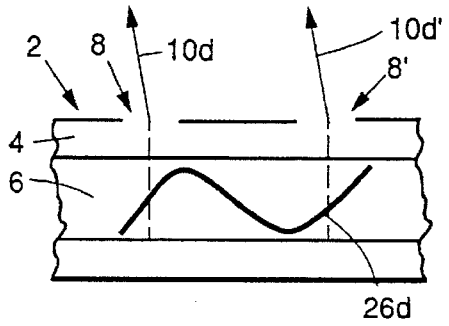

In FIGS. 4*a* and 4*b* the output beams are scanned within an angular range on one side of a perpendicular to the waveguide. In FIGS. 4*c* and 4*d*, by contrast, an arrangement is illustrated in which the output beams are scanned between offset angles on opposite sides of the perpendicular. FIG. 4*c* illustrates a situation in which the core's optical axis is perpendicular to the input beam polarization, producing an input beam wavefront 26*c* within the core with a minimum wavelength. This wavelength is shown as being slightly less than the spacing between the successive waveguide slots 8 and 8', causing the output beams 10*c* and 10*c*' to be angularly offset in a clockwise direction from a perpendicular to the waveguide. In FIG. 4*d* the core 6 has been rotated so that its optical axis is parallel to the input beam polarization, increasing the phase delay and lengthening the wavelength of the input beam wavefront 26*d* so that it somewhat exceeds the spacing between the successive slots 8 and 8'. In this situation the output beams 10*d* and 10*d*' are angularly offset from a perpendicular to the waveguide, but in a counter-clockwise direction. The output beams will scan between the directional limits illustrated in FIGS. 4*c* and 4*d* as the core 6 continues to rotate within the waveguide. Since the output beams scan from one angular extreme to the other during each 90° core rotation, a full scanning cycle will be completed for each 180° rotation, with the output beams returning to the original directions they had at the beginning of the rotation. A full 360° core rotation thus produces two output scanning cycles.

One of the advantages of the present antenna system is that it operates as a receiver equally as well as a transmitter. Due to the anisotropic medium's completely reciprocal forward and backward optical propagation constants, the antenna can act as both a radiating and a receiving device. It is thus useful for solely transmission applications, for solely reception applications, and for transceiver applications. The size of the angular scan that can be obtained depends upon the degree of anisotropicity (birefringence) of the phase delay medium 6. Increasing the concentration of the conductive particles or liquid crystals in the medium will increase its birefringence, and thus enlarge the scanning angle. With a high birefringence on the order of 0.5, scanning angles on the order of 30°–40° are achievable.

Figure 5:
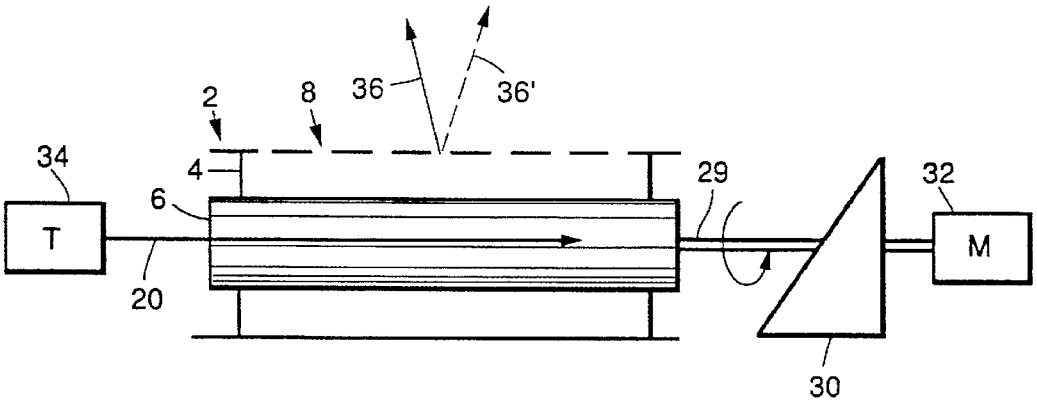
FIGS. 5 and 6 are simplified sectioned views illustrating the use of the antenna in transmit and receive modes, respectively.
Figure 6:
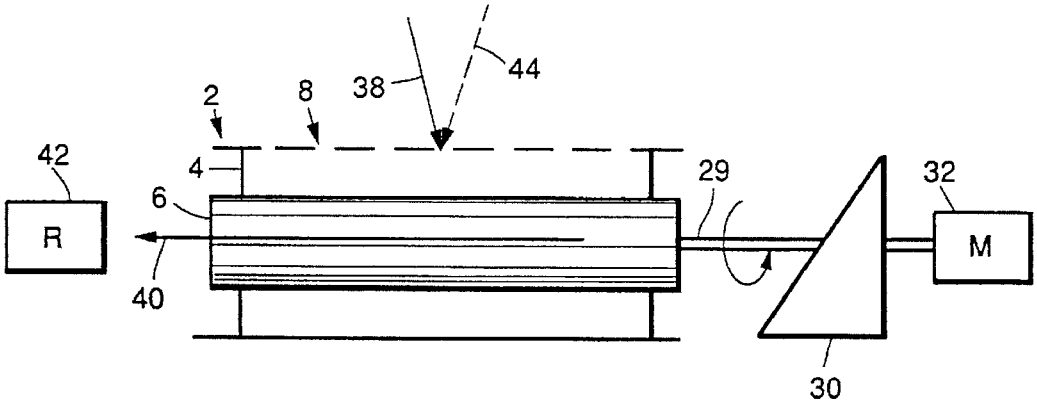

FIGS. 5 and 6 respectively illustrate transmitter and receiver applications of the invention. The rotating anisotropic core 6 is mounted on a thin shaft 29 that extends through a termination fixture 30 from a rotation control device such as a small servo-control or stepper electric motor 32. Due to the small load required to rotate the core 6, the motor's power consumption is small, and many different kinds of servo-control electric motor can be used. A suitable input beam 20 of the desired frequency is produced by a transmitter 34 and directed through the waveguide core 6 parallel to its rotational axis. The angular scanning range of the output beam from the array of waveguide slots 8 is indicated by a solid arrow 36 and a dashed line arrow 36'.

In a reciprocal receive mode, illustrated in FIG. 6, the antenna has an acceptance angle that is periodically scanned back and forth as the core 6 is rotated, with two full acceptance angle scan cycles for each complete core rotation. This is a reciprocal operation from the transmitting antenna of FIG. 5. In one rotational position of the core 6, an input beam 38 that enters the waveguide slot 8 at a given angle will produce a polarized output beam 40 that is propagated out through the core to a receiver 42. With ideal operation, the antenna's acceptance angle for a given core rotational position will be restricted to a single angle, and input beams at other angles will fail to generate an output beam within the core. As the core rotates, its acceptance angle will be periodically scanned in a manner similar to the scanning of the radiated output beam in the transmission mode. Thus, when the core has rotated 90°, the acceptance angle will have shifted to that indicated by the input beam 44 in FIG. 6. If the beam received by the waveguide is restricted to a single angle, a series of pulsed output beams will thus be generated in the core 6 and transmitted to the receiver 42 as the core rotates, with a pulse produced each time the antenna's acceptance angle is coincident with the beam's input angle. The beam's input angle can thus be determined by comparing the sequence of pulses delivered to receiver 42 with the angular position of the core when each pulse was produced.

The anisotropic core 6 has been described thus far as a continuous cylindrical member. Non-cylindrical rotatable shapes could also be used, although a cylinder lends itself best to mechanical support. Also, the core could be segmented as illustrated in FIG. 7. In this embodiment the core consists of a series of parallel disks 46, with the disk periodicity related to waveguide wavelength, and is determined experimentally. A shaped core structure such as this can generally be fabricated by polymerization within a mold.

As mentioned previously, waveguide shapes other than rectangular can also be used. For example, a circular waveguide 48, illustrated in FIG. 8*a*, could be used if the dominant propagating mode's field pattern 50 is asymmetric with respect to the center of the waveguide, as shown in FIG. 8*a*. However, FIG. 8*b* illustrates a circular waveguide 52 with a symmetrical field pattern 54. This arrangement is not suitable for the invention, since rotating the core will not result in a large enough net change in the effective refractive index seen by a beam propagating along the waveguide.

In an experimental demonstration of the invention, a prototype rotating anisotropic core edge shunt, in-phase slotted waveguide linear array antenna using a 30 GHz waveguide was fabricated. The antenna had 26 slots, angled at 15° from the waveguide axis, and with a slot with 0.1 cm each. The calculated slot spacing that was used, for a nominally broadside beam angle and an average refractive index of 1.6, was 0.7 cm. The slotted waveguide was provided with an interior Teflon sleeve having a cylindrical center opening with a diameter of approximately 0.31 cm.

An anisotropic rod was made by dispersing nickel plated microtubules (0.6% by weight) in a 50:50 mixture of Capcure 3-800:Epon 815, and then thermally polymerizing this composite fluid at 85° C. in the presence of a magnetic field. This composite solid was made in a Teflon tube (2.8 mm O.D., 2.1 mm I.D., and about 20 cm long), which was held in a glass tube during polymerization for mechanical stability while being formed. The thermal curing period was 19 hours, after which it was cooled to room temperature and removed from the glass tube. The Teflon tube was left on, and the anisotropic rod in the tube was cut to the required length for use as a rotating core.

The rotating core's birefringence is a function of the number concentration N and the polarizability $\alpha$ of the metallized microtubules in accordance with the equation:

$$\Delta n = \sqrt{\frac{1+8\pi\alpha_o N}{3-4\pi\alpha_o N}} - \sqrt{\frac{1+8\pi\alpha_e N}{3-4\pi\alpha_e N}}\ .$$

The prototype core's effective birefringence was estimated experimentally to be about 0.1 at 0.6 weight % concentration of the metallized microtubules. For purposes of the experiment the core was manually rotated with the Teflon sleeve on it. The resulting antenna was tested as a receiving device by placing it sideways on a rotating table and rotating the table as an input beam was directed onto the antenna at a constant direction; a relative scanning between the input beam and antenna was thus produced. The sensitivity of the antenna to the input beam was detected with the core's optical axis first parallel to the E-field vector of a propagating mm. beam inside the waveguide, and then perpendicular to the E-field vector. The angular position of the table at which the antenna displayed a peak response to the input beam was distinctly different for the two rotational positions of the core. The response for a parallel orientation is given in FIG. 9 by curve 56, while the response for a perpendicular orientation is given by curve 58. The angular separation of the intensity peaks was approximately 3.5°.

A new scanning array antenna has thus been shown and described that does not require high precision machining, whose solid anisotropic core can be easily and inexpensively fabricated, and whose major components can be fabricated separately and then assembled. All of the components can be molded and fabricated from plastic, with appropriate parts metallized; the fabrication process is suitable for large volume mass production at a low production cost per antenna. The resulting antenna is physically compact; typical dimensions for a 60 GHz antenna are approximately 1×1×10 cm. The antenna is substantially insensitive to a wide range of temperatures, is reciprocal for transmission and reception purposes, has a very low power consumption and is mechanically rugged. All moving parts can be hermetically sealed, with very low maintenance requirements. The scanning rate is programmable. Rapid beam aiming (up to 10 KHz) at different fixed angles is possible due to a small moment of inertia.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A scanning antenna operable with a polarized input beam, comprising:

a solid aperiodic phase delay medium comprising a dispersion of aligned elements within a dielectric matrix and having an optical axis and an anisotropic refractive index, means for effecting a relative rotation between said phase delay medium's optical axis and the input beam polarization when said input beam is incident upon said phase delay medium, and thereby varying the beam's wavelength within said medium, and output radiating means for radiating a plane wave output signal from said medium at an angle that varies as a function of the angle between the medium's optical axis and the polarization of said input beam for a wideband range of input beam frequencies.

2. The scanning antenna of claim 1, wherein said output radiating means comprises an apertured waveguide, said solid phase delay medium is disposed within said waveguide, and said means for effecting a relative rotation between said phase delays medium's optical axis and the polarization of said input beam comprises means for rotating said phase delay medium.

3. The scanning antenna of claim 2, said apertured waveguide comprising a slotted waveguide having a periodic series of parallel radiation emitting slots that are oriented at an offset angle to the waveguide axis.

4. The scanning antenna of claim 2, wherein said solid phase delay medium is generally cylindrical about an axis, and is rotatable about said axis.

5. The scanning antenna of claim 4, said waveguide comprising a rectangular waveguide.

6. The scanning antenna of claim 5, said waveguide including an interior dielectric sleeve for said phase delay medium, said sleeve having a rectangular outer surface complementary to said waveguide and a cylindrical inner opening that provides a rotational bearing surface for said cylindrical phase delay medium.

7. The scanning antenna of claim 2, wherein said solid phase delay medium is substantially continuous.

8. The scanning antenna of claim 2, wherein the apertures of said waveguide are spaced in succession at substantially single wavelength increments of said beam in said phase delay medium, said single wavelength increments taken when the medium's optical axis is at a predetermined angle to the beam polarization.

9. The scanning antenna of claim 1, said solid phase delay medium comprising a dispersion of generally aligned elongate conductive members in an isotropic dielectric.

10. The scanning antenna of claim 9, wherein said elongate conductive members comprise graphite fibers, aluminum needle-shaped particles, steel wires or metallized microtubules.

11. The scanning antenna of claim 9, wherein said elongate conductive members are not more than about 1 mm. in length.

12. The scanning antenna of claim 11, wherein the lengths of said elongate conductive members are at least about ten times their widths.

13. The scanning antenna of claim 9, said dielectric comprising a polymer.

14. The scanning antenna of claim 1, said solid phase delay medium comprising a liquid crystal and liquid crystal polymer mixture.

15. The scanning antenna of claim 1, said solid phase delay medium comprising a dispersion of generally aligned elongate conductive members in a liquid crystal medium.

16. A scanning antenna, comprising:

a laterally apertured waveguide, a moveable solid aperiodic phase delay medium within said waveguide that comprises a dispersion of aligned elements within a dielectric matrix and causes radiation to be emitted from the lateral waveguide apertures in response to electro-magnetic radiation over a predetermined wideband frequency range propagating through said medium, the degree of phase delay imparted by said medium to said electro-magnetic radiation and thereby the angle of said emitted radiation varying with the position of said medium within said waveguide, and means for varying the position of said medium within said waveguide to produce a scanning plane wave radiation emission from said waveguide.

17. The scanning antenna of claim 16, said phase delay medium comprising a solid anisotropic medium having a rotational axis and characterized by a phase delay that varies with the medium's rotational position about said axis, and said means for varying the phase delay medium's position comprises means for rotating it about its axis.

18. An antenna, comprising:

an apertured waveguide having a signal propagation axis, and a rotatable solid aperiodic phase delay medium within said waveguide, said phase delay medium comprising a dispersion of aligned elements within a dielectric matrix and having an anisotropic refractive index, a rotational axis and an optical axis with a component perpendicular to said rotational axis, said medium causing plane wave radiation to be emitted out from said waveguide apertures in response to a polarized electro-magnetic signal propagating through the waveguide over a predetermined wideband frequency range, said medium when rotated causing the angle at which said radiation is emitted from said waveguide to vary.

19. The antenna of claim 18, said apertured waveguide comprising a rectangular waveguide with a periodic series of parallel radiating slots that are oriented at an offset angle to the waveguide axis.

20. A scanning array transceiver system, comprising:

a laterally apertured waveguide, a moveable solid phase aperiodic delay medium within said waveguide comprising a dispersion of aligned elements within a dielectric matrix and having an anisotropic refractive index the magnitude of which varies with the medium's position within said waveguide, transmitter means for directing a polarized electromagnetic transmit signal within a predetermined frequency range through said medium within said waveguide, said medium producing a plane wave radiation emission through the lateral apertures of said waveguide in response to transmit signals within a wideband signal range, receiver means for receiving a polarized electromagnetic receive signal from said medium, said medium producing a receive signal in response to radiation within a predetermined wideband frequency range entering said medium through said waveguide apertures at a predetermined acceptance angle, and means for varying the position of said medium within said waveguide to vary the angle at which radiation is transmitted through said waveguide apertures in a transmit mode, and to vary the radiation acceptance angle for which said medium produces a receive signal during a receive mode.

21. The scanning array transceiver system of claim 20, wherein said solid phase delay medium is rotatable about a rotational axis that is generally parallel to the waveguide and has an optical axis that is generally perpendicular to its rotational axis, and said means for varying the position for said medium comprises means for rotating said medium about its rotational axis.

22. An electromagnetic radiation scanning method, comprising:

positioning a solid aperiodic anisotropic phase delay medium comprising a dispersion of aligned elements within a dielectric matrix within a waveguide that has periodically spaced apertures, directing a polarized electro-magnetic input beam through said medium, emitting plane wave electro-magnetic radiation from said waveguide apertures in response to said input beam within a wideband range of frequencies, at an angle determined by the differential between the periodicity of said apertures and the wavelength of said input beam within said medium, and varying the position of said medium relative to said waveguide to vary the effective refractive index of said medium relative to said input beam, and thereby vary the wavelength of said beam within said medium and the angle at which said electro-magnetic radiation is radiated from said waveguide.

23. The method of claim 22, said phase delay medium being rotatable about a rotational axis that is generally parallel to the direction of said input beam through the waveguide, and having an optical axis that is generally perpendicular to said rotational axis, wherein the position of said medium is varied by rotating it about its rotational axis.

24. An electromagnetic radiation reception method, comprising:

positioning an aperiodic solid anisotropic phase delay medium comprising a dispersion of aligned elements within a dielectric matrix within a waveguide that has periodically spaced apertures, receiving within said medium electromagnetic radiation signals that enter the waveguide through said apertures, responding to received radiation within a wideband frequency range that has entered the waveguide at a predetermined acceptance angle by generating an electro-magnetic output beam within said medium, transmitting said output beam out of said medium to a receiver, and varying the position of said medium relative to said waveguide to vary the effective refractive index of said medium relative to an output beam propagating through the medium, and thereby varying said acceptance angle.

25. The method of claims 24, said phase delay medium being rotatable about a rotational axis that is generally parallel to the direction of said output beam through said medium, and having an optical axis that is generally perpendicular to said rotational axis, wherein the position of said medium is varied by rotating it about its rotational axis.

* * * * *